US007284557B1

(12) United States Patent
Williams

(10) Patent No.: US 7,284,557 B1
(45) Date of Patent: Oct. 23, 2007

(54) HAIR STYLING TOOL

(76) Inventor: Vickie Williams, 163 W. 71st St. Apt. 2F, New York, NY (US) 10023

( * ) Notice: Subject to any disclaimer, the term of this patent is extended or adjusted under 35 U.S.C. 154(b) by 289 days.

(21) Appl. No.: 10/793,633

(22) Filed: Mar. 4, 2004

(51) Int. Cl.
*A45D 7/02* (2006.01)

(52) U.S. Cl. ..... 132/212; 7/118; 7/168

(58) Field of Classification Search ..... 132/212, 132/213, 286, 333; 7/118, 167, 168, 170, 7/128, 129; 66/121–123, 116–119; 81/427.5
See application file for complete search history.

(56) References Cited

U.S. PATENT DOCUMENTS 1,187,842 A * 6/1916 Kaas ..... 7/168
1,530,070 A * 3/1925 Bovee ..... 132/314
1,561,262 A * 11/1925 Martin ..... 7/118
2,237,378 A * 4/1941 Thienemann ..... 33/501
2,575,652 A * 11/1951 Bovee ..... 294/99.2
3,222,891 A * 12/1965 Wignall ..... 66/121
3,825,961 A * 7/1974 Klein ..... 7/106
5,279,255 A 1/1994 Northcutt ..... 119/83
5,283,920 A * 2/1994 Plummer ..... 7/106
5,417,230 A 5/1995 Wood ..... 132/212
5,497,796 A 3/1996 Mochizuki ..... 132/201
6,694,558 B2 * 2/2004 Ping ..... 7/128
6,698,049 B2 * 3/2004 McLoudrey ..... 7/158

* cited by examiner

*Primary Examiner*—Todd E. Manahan
*Assistant Examiner*—Rachel A. Running
(74) *Attorney, Agent, or Firm*—Goldstein Law Offices, P.C.

(57) ABSTRACT

A hair styling tool for performing weaves without leaving a bulky and unkempt look and without damaging hair including a housing having a plurality of compartments formed therein. The hair styling tool includes a plurality of hair styling tools each having interior ends and exterior ends. The interior ends are pivotally coupled with the housing whereby each of the hair styling tools being removably positionable within the plurality of compartments in a closed orientation. Each of the plurality of hair styling tools have a styling tool portion disposed on the exterior ends thereof.

3 Claims, 2 Drawing Sheets

HAIR STYLING TOOL

BACKGROUND OF THE INVENTION

The invention relates to a hair styling tool for performing weaves without leaving a bulky and unkempt look and without damaging hair.

Throughout history, men and women alike have modified and arranged their hair as a means of approving appearance, designating class and celebrating religion. Today, although the social, religious and political implications of styling hair has vastly changed, grooming the hair as a means of self expression and self improvement is still in practice. One particularly popular way many choose to style their hair is through a simple hair weave. Hair weaving is a trend that is growing among all groups of people with all textures of hair. A hair weave is a process through which natural or synthetic hair strands are bonded to a person's existing hair, typically at the root of the hair shaft, directly above the scalp. This process is especially popular among African American men and women, offering these consumers a simple way in which to sport long, straight or braided hairstyles without the hassle associated with growing out thick, textured hair or repeatedly visiting the salon for a perm.

While a beautifully rendered perm is almost undetectable, a poorly styled weave can look bulky or unkempt and can actually serve to damage the hair. The weight caused by glues or waxes used to apply a weave can actually weigh down the fragile hair shaft, pinching the hair. These pinch points create a small spot on the hair shaft that can become thin and vulnerable to a break. Further, as the hair grows out, attaching the weave to new hair continually damages the hair along the entire shaft. As many who have suffered a "bad" weave would attest, spending hundreds of dollars on a weave, only to have one's natural hair become irrevocably damaged can be an extremely frustrating experience. Because these methods of weaving the hair can be so damaging, many consumers prefer the traditional sewn-in weave, affixing the extensions to the hair by way of needle and thread. Typically far less expensive than the wax fusion method, and longer lasting than weaves applied with glue, a sewn-in weave is the favored method of countless consumers. As with other weaving methods however, sewn-in weaves can take many hours to complete and if not properly applied can result in knotty, unattractive lumps which can detract from the client's overall appearance. Further, as with bulky hair glue or wax, these heavy knots can cause the hair shaft to weaken, potentially breaking the hair.

The present invention attempts to solve the above referenced problems by providing a hair styling tool that will allow a person's hair to be woven in a manner that is comfortable to them without causing damage to the hair shafts.

Various hair treatment implements are well known in the art. Specifically, U.S. Pat. No. 5,417,230 to Wood discloses a hair styling tool comprised of a shaft with a U-shaped hook for creating a band of hair. U.S. Pat. No. 5,497,796 to Mochizui discloses a means for joining hair using a needle device. U.S. Pat. No. 5,279,255 to Northcutt discloses a horse hair banding device.

While these units may be suitable for the particular purpose employed, or for general use, they would not be as suitable for the purposes of the present invention as disclosed hereafter.

SUMMARY OF THE INVENTION

It is an object of the invention to produce a hair styling tool for performing weaves without leaving a bulky and unkempt look and without damaging hair.

The present invention includes a housing having a generally oblong rectangular configuration. The housing has a plurality of compartments formed therein. Each of the compartments have an integrally formed recess therein. The housing has a gripping section on an upper surface thereof. The present invention includes a plurality of hair styling tools each having interior ends and exterior ends. The interior ends are pivotally coupled with the housing whereby each of the hair styling tools are removably positionable within the plurality of compartments in a closed orientation. Each of the plurality of hair styling tools have a styling tool portion disposed on the exterior ends thereof. Some of the styling tool portions are comprised of a plurality of hook portions. The plurality of hook portions include a small hook portion, a medium hook portion, a large hook portion and a largest hook portion. Each of the hook portions are comprised of a downwardly turned free end. The hook portions are further comprised of an arm member extending outwardly in an angular orientation towards the downwardly turned free end. One of the styling tool portions is comprised of a U-shaped cutting member. The cutting member has interior cutting edges.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
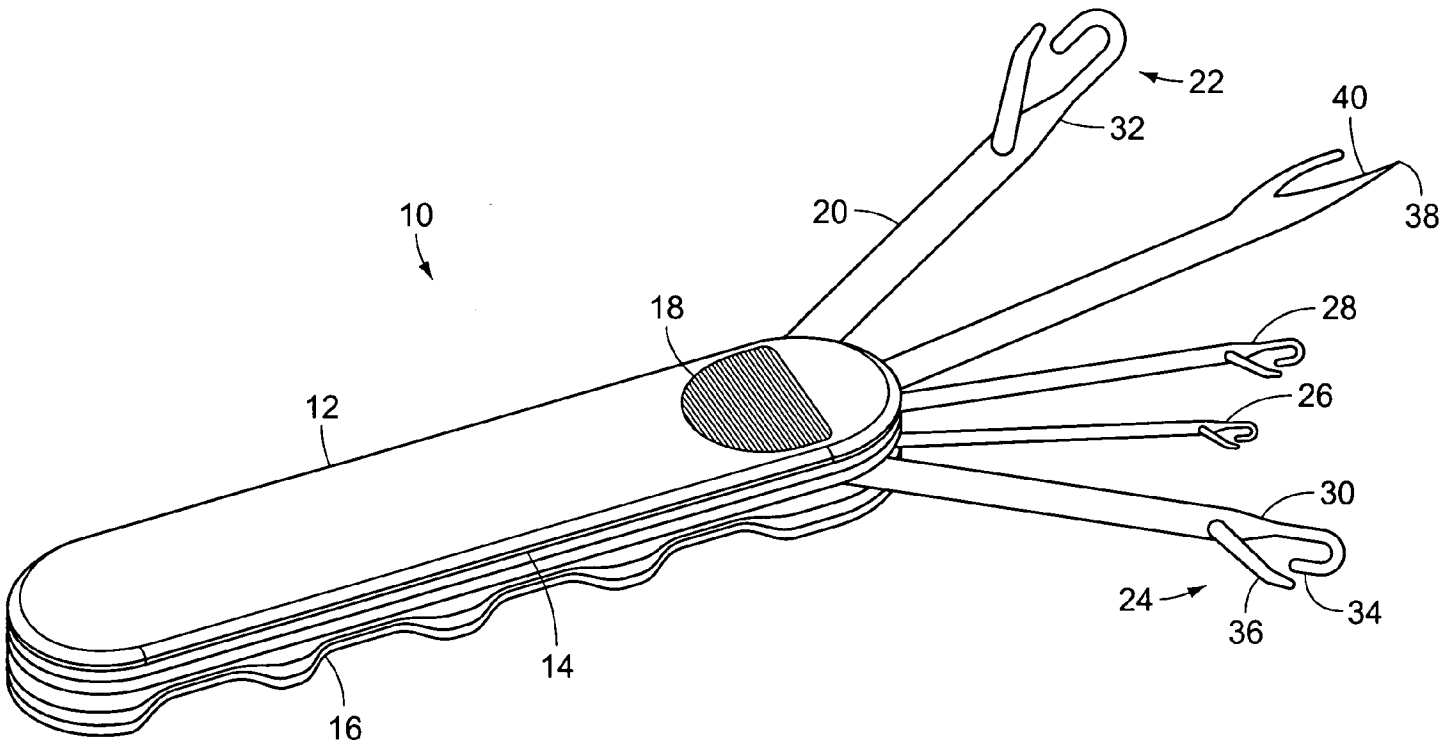
FIG. 1 is a perspective view of the present invention illustrated with all of the tools in an extended orientation.

FIG. 1 illustrates a hair styling tool 10 for performing weaves without leaving a bulky and unkempt look and without damaging hair. In its broadest context, the present invention is comprised of a housing and a plurality of hair styling tools. The hair styling tool 10 is a universal tool for use performing several different hair weave techniques faster and more sufficiently.

The housing 12 has a generally oblong rectangular configuration. The housing 12 essentially resembles a housing used in army knives and the like. The housing 12 has a plurality of compartments 14 formed therein. Each of the compartments 14 have an integrally formed recess 16 therein. The housing 12 has a gripping section 18 on an upper surface thereof. The gripping section 18 is in a position that will allow a user to position their thumb thereon when manipulating the present invention. Note FIG. 2.

The plurality of hair styling tools 20 each have interior ends and exterior ends. The interior ends are pivotally coupled with the housing 12 whereby each of the hair styling tools 20 are removably positionable within the plurality of compartments 14 in a closed orientation. A user simply will grab one of the tools through the recess 16 to pull it outwardly of the compartment 14. Each of the plurality of hair styling tools 20 have a styling tool portion 22 disposed on the exterior ends thereof. Some of the styling tool portions 22 are comprised of a plurality of hook portions 24. The plurality of hook portions 24 include a small hook portion 26, a medium hook portion 28, a large hook portion 30 and a largest hook portion 32. Each of the hook portions 24 are comprised of a downwardly turned free end 34. The hook portions 24 are further comprised of an arm member 36 extending outwardly in an angular orientation towards the downwardly turned free end 34. One of the styling tool portions 22 is comprised of a U-shaped cutting member 38. The cutting member 38 has interior cutting edges 40. The hook portions 24 are configured for use with varying hair textures and strand sizes. The cutting member 38 is comparative in size with the largest hook portion 32 and would be used when sewing extensions into the hair.

Figure 2:
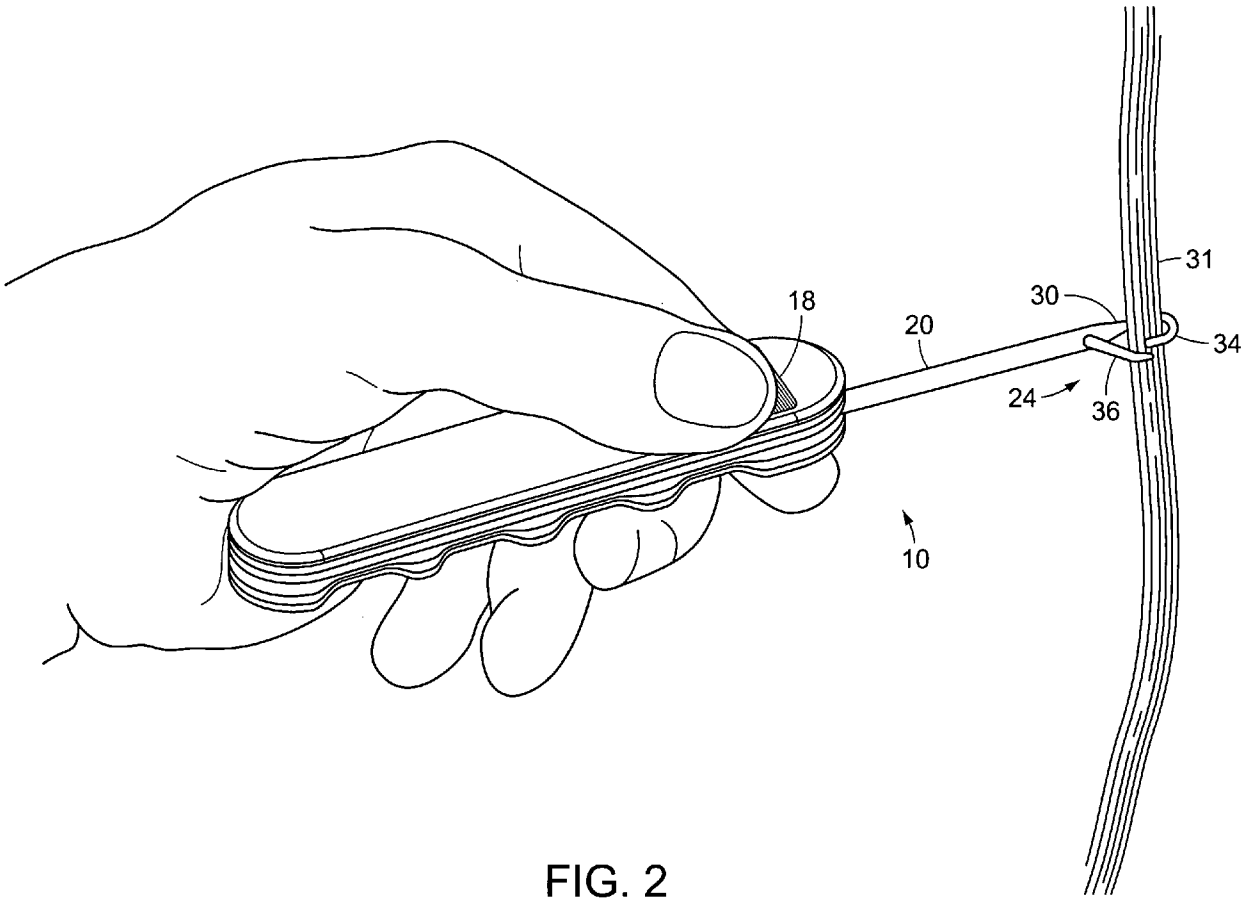
FIG. 2 is a perspective view of the present invention illustrated in use.

FIG. 2 illustrates the hair styling tool 10, wherein the gripping section 18 is shown being held by the user in position having their thumb thereon for manipulating the styling tool 10. One of the hair styling tools 20 having a large hook portion 30 disposed on the exterior end thereof is shown in use weaving a strand of hair 31. The strand of hair 31 is grabbed and held securely by the large hook portion 30. The hair 31 enters the large hook portion 30 at the connection between the downwardly turned free end 34 and the arm member 36. Once the large hook portion 30 of the hair styling tool 20 engages the hair 31 the user can easily weave the hair 31 without leaving a bulky and unkempt look.

In conclusion, herein is presented a hair styling tool 10 for performing weaves without leaving a bulky and unkempt look and without damaging hair. The invention is illustrated by example in the drawing figures, and throughout the written description. It should be understood that numerous variations are possible, while adhering to the inventive concept. Such variations are contemplated as being a part of the present invention.

What is claimed is:

1. A hair styling tool for performing weaves without leaving a bulky and unkempt look and without damaging hair comprising, in combination:

a housing having an upper surface having a gripping section, the housing also having a plurality of compartments formed therein, each of the compartments has an integrally formed recess therein; and a plurality of hair styling tools each having interior ends and exterior ends, the interior ends being pivotally coupled with the housing whereby each of the hair styling tools being removably positionable within the plurality of compartments in a closed orientation, each of the plurality of hair styling tools having a styling tool portion disposed on the exterior ends thereof, wherein at least some of the styling tool portions are comprised of a plurality of hook portions, the plurality of hook portions including a small hook portion, a medium hook portion, a large hook portion and a largest hook portion.

2. The hair styling tool as set forth in claim 1, wherein each of the hook portions are comprised of a downwardly turned free end, the hook portions being further comprised of an arm member extending outwardly in an angular orientation towards the downwardly turned free end.

3. A hair styling tool for performing weaves without leaving a bulky and unkempt look and without damaging hair comprising, in combination:

a housing having a generally oblong rectangular configuration, the housing having a plurality of compartments formed therein, each of the compartments having an integrally formed recess therein, the housing having a gripping section on an upper surface thereof; and a plurality of hair styling tools each having interior ends and exterior ends, the interior ends being pivotally coupled with the housing whereby each of the hair styling tools being removably positionable within the plurality of compartments in a closed orientation, each of the plurality of hair styling tools having a styling tool portion disposed on the exterior ends thereof, some of the styling tool portions comprising a plurality of hook portions, the plurality of hook portions including a small hook portion, a medium hook portion, a large hook portion and a largest hook portion, each of the hook portions being comprised of a downwardly turned free end, the hook portions being further comprised of an arm member extending outwardly in an angular orientation towards the downwardly turned free end, one of the styling tool portions being comprised of a U-shaped cutting member, the cutting member having interior cutting edges.

* * * * *